United States Patent [19]

Nannen

[11] 4,357,974

[45] Nov. 9, 1982

[54] WOOD SPLITTING MAUL

[76] Inventor: Jack W. Nannen, 2712 Orchard La., Mount Penn, Pa. 19606

[21] Appl. No.: 183,307

[22] Filed: Sep. 2, 1980

[51] Int. Cl.[3] ..... B26B 23/00

[52] U.S. Cl. ..... 145/2 R; 144/193 D

[58] Field of Search ..... 145/2 R; 144/193 D, 144/193 E; 254/104

[56] References Cited

U.S. PATENT DOCUMENTS

| | | | |
|---|---|---|---|
| D. 16,631 | 4/1886 | Bakewell | 145/2 R |
| D. 21,253 | 12/1891 | Rogers | 145/2 R |
| 402,936 | 5/1889 | Kelly | 145/2 R |
| 445,160 | 1/1891 | Carver | 145/2 R |
| 4,044,808 | 8/1977 | Kolonia | 144/193 D |

FOREIGN PATENT DOCUMENTS

| | | | |
|---|---|---|---|
| 69590 | 9/1945 | Norway | 145/2 R |

*Primary Examiner*—James L. Jones, Jr.
*Attorney, Agent, or Firm*—Richard D. Weber

[57] ABSTRACT

A maul head for a wood splitting maul includes a raised ear disposed centrally on each side face of the head. The ears are of a substantially smaller width than the side faces of the maul head and are configured to provide a wedge shaped entry portion which is spaced from the cutting edge of the side faces. The distance between the outer faces of the ears progressively increases from the leading edge to the trailing edge of the ears. The ears provide an increased splitting action after the initial penetration of the cutting edge.

4 Claims, 13 Drawing Figures

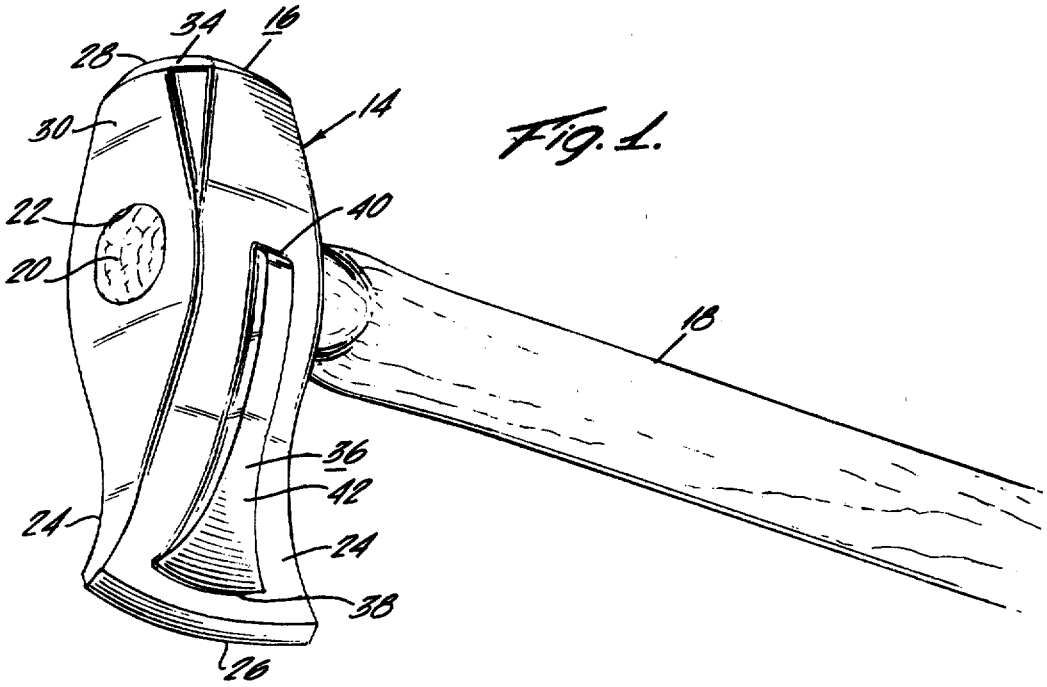
Fig. 1.
Fig. 2.
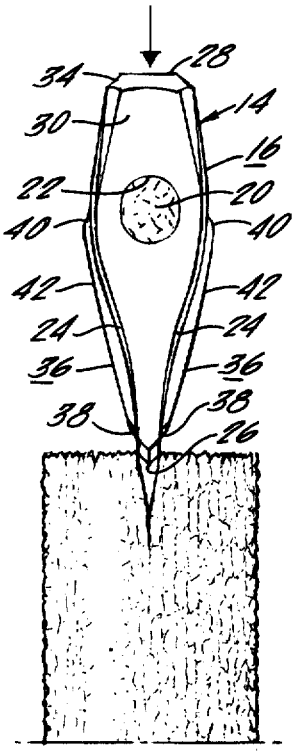
Fig. 3.
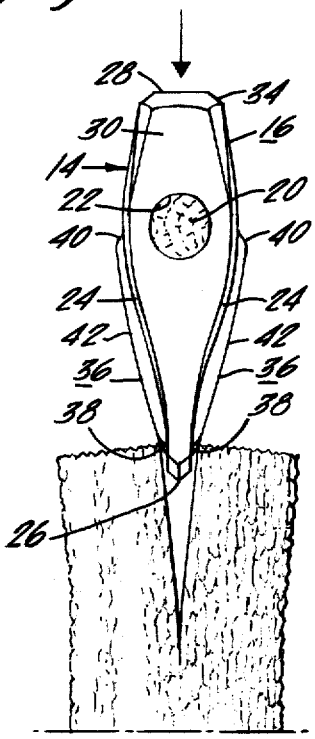
Fig. 4.
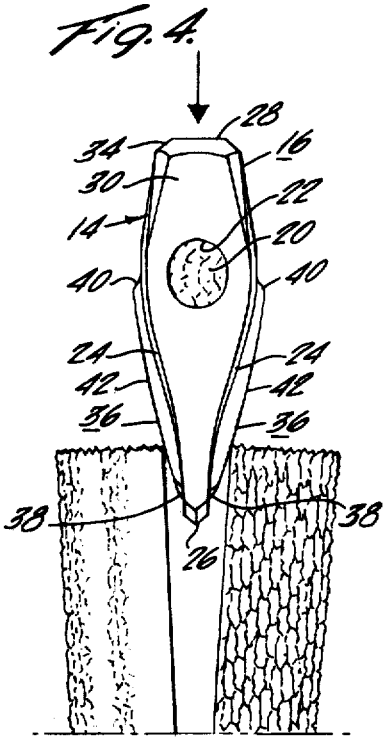

WOOD SPLITTING MAUL

BACKGROUND OF THE INVENTION

The present invention relates generally to hand tools for chopping and splitting wood and relates more particularly to a wood splitting maul having a novel head shape which facilitates log splitting.

The rapidly escalating costs and periodic shortages of conventional home heating fuels such as oil and natural gas have given rise to a greatly increased consumption of firewood, burned both in fireplaces and in wood burning stoves. Although commercially cut and split firewood is available, the cost has risen to the point that in many areas it is comparable to the cost of the conventional fuels. Accordingly, many homeowners have taken to cutting and splitting their own logs. Although chain saws in small sizes can be purchased rather cheaply, powered equipment for splitting logs is too expensive to be within reach of the average homeowner. The basic hand tools available for the splitting operation accordingly remain the wedge and sledge, or the splitting maul. A conventional wood chopping axe is not suitable for splitting logs of any size because of its light weight and thin blade which tends to become buried in the wood before producing any splitting effect.

The use of wedges and a sledge hammer to split wood is a time honored method which normally requires a number of sledge strokes and a considerable degree of skill. The use of wedges can be frustrating due to the tendency of the wedges to follow a course other than that desired and further because of their tendency to be swallowed by certain types of wood before the log splits in two. It is accordingly sometimes necessary to use a number of wedges to split a single log and, when the log finally does split, the wedges can fly out in unpredictable directions. There is also a tendency in some woods for the wedge to remain stuck in a section of the log even after the log has split, necessitating a further operation to recover the wedge.

The splitting maul has gained favor in recent years since it is easier to use than the wedge and sledge and does not require as much accuracy. Although the splitting maul can become lodged in a partially split log, the long handle makes removal a simple matter. The maul is not as well suited for extremely large logs as the sledge with multiple wedges, but is generally superior for splitting smaller logs, for example those of 10 inches in diameter and less. For smaller logs, the splitting maul is not only easier to use, but is considerably faster than the wedge and sledge.

In the case of either an axe, wedge, or splitting maul, in order for the wood to yield to initiate a splitting action, the entering edge of the splitting element must be relatively thin and sharp. However, once this entering edge has initiated a splitting of the wood, much of the energy of the splitting stroke of the implement is dissipated in the frictional drag of the implement as the faces thereof descend into the log without greatly increasing the width of the split. As a result, the initial splitting stroke using either a wedge, a splitting maul, or with thinner stock, an axe, often produces only a partial split with the splitting element lodged securely in the partially split log.

In an effort to convert more of the downwardly directed energy of the splitting element into the lateral separation of the halves of the log being split, a novel splitting axe has recently been developed utilizing a pair of opposed pivotally mounted jaws which engage the opposite portions of the logs after the cutting edge of the axe has penetrated partway thereinto to initiate the split. The jaws are pivotally mounted in such a fashion that the axe blade cannot bury itself in the log since the jaws will substantially arrest the downward movement and convert the energy of the axe head into lateral thrust, splitting the log into two portions.

Although the splitting axe utilizing the pivoted jaws works effectively, it is a relatively expensive device in view of the several moving parts involved and the need to secure the parts with suitable pivot pins. Furthermore, the moving parts will in time wear or possibly break, requiring replacement. Additionally, the splitting axe is difficult to use with extremely dense woods such as oak, since the jaws may engage the end of the log before any splitting tendency of the log has been achieved by the axe cutting edge, in which event the axe will simply bounce back without initiating any splitting action.

BRIEF SUMMARY OF THE INVENTION

The present invention represents a simple but significant improvement in splitting maul construction and involves basically a conventional splitting maul having a pair of ears disposed on the maul head side faces, which ears are an integral part of the maul head. The ears are of a substantially smaller width than the side faces of the maul head and are configured to provide a wedge shaped entry portion which is spaced from the cutting edge of the side faces. The ears function to provide a greatly increased splitting action after the initial penetration of the cutting edge has initiated the splitting of a log. The narrow width of the ears minimizes friction and accordingly assures that the kinetic energy of the maul head is converted as efficiently as possible into a transversely directed splitting force.

In view of the above, it can be understood to be a primary object of the present invention to provide an improved splitting maul for splitting logs which permits the log splitting to be accomplished more rapidly and with less effort.

It is a further object of the invention to provide an improved splitting maul having no moving parts and which can be formed as an integral part of the maul head.

It is a further object of the invention to provide an improved splitting maul as described of a relatively simple construction which can be economically manufactured.

Additional objects and advantages of the invention will be more readily apparent form the following detailed description of an embodiment thereof.

BRIEF DESCRIPTION OF THE DRAWINGS

FIG. 1 is a perspective view of a splitting maul in accordance with the present invention, showing only a portion of the handle thereof;

FIG. 2 is a view of the maul as it initially penetrates into a log;

FIG. 3 is a view similar to FIG. 2 showing a further stage of penetration of the maul into the log with the ears just beginning to engage the log portions and begin their splitting function;

FIG. 4 is a view similar to FIGS. 2 and 3 showing the completion of the splitting of the log;

DESCRIPTION OF THE PREFERRED EMBODIMENT

Figure 6:
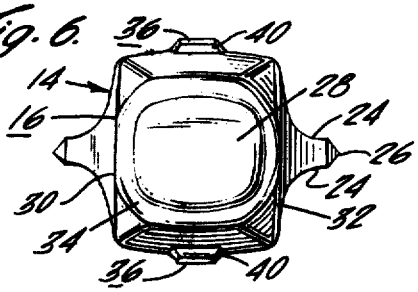
FIG. 6 is an end view of the hammer face end of the splitting maul head shown in FIG. 5.
Figure 8:
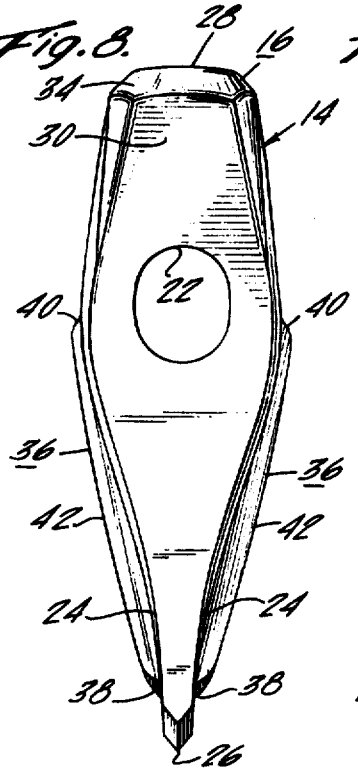
FIG. 8 is a view of the outer face of the splitting maul as shown in FIG. 5.

Referring to the drawings, and particularly FIG. 1 thereof, a splitting maul generally designated 14 is illustrated comprising a maul head 16 and a handle 18 connected thereto (only partly shown in FIG. 1). The handle 18 is attached to the maul head 16 in a conventional manner which involves the fitting of one end 20 thereof within a transverse bore 22 of the head. The handle may be secured within the head by the use of wedges, bonding agents, or any other suitable means.

Figure 5:
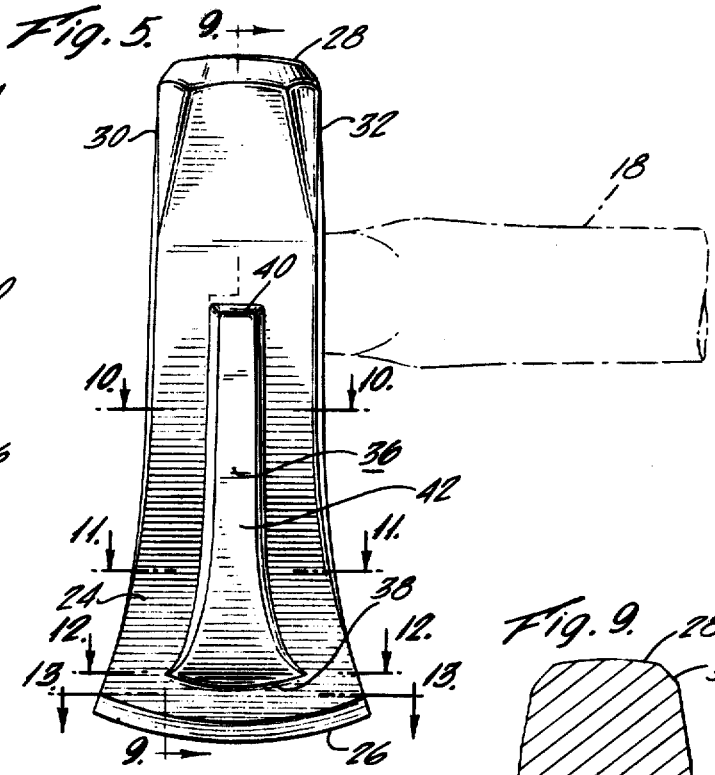
FIG. 5 is an enlarged side elevational view of a splitting maul head of the type shown on the maul of FIGS. 1-4.

The maul head 16 is, except for the improvement of the present invention, of a conventional shape and comprises a pair of opposed side faces 24, 24 which converge to form at one end of the head a cutting edge 26, which cutting edge is preferably beveled as shown to provide a sharp but durable edge designed to separate rather than cut the end grain of a wood log. As shown in FIG. 5, the width of the side faces 24 flares outwardly toward the cutting edge so that the cutting edge has a length which is substantially greater than the width of the side faces in the region of the handle.

The maul head 16 terminates at the end opposite the cutting edge 26 in a blunt hammer face 28 which may be used to drive wedges or any other function requiring a hammering action, such as driving stakes, etc. As shown in FIG. 6, the hammer face 28 is of a generally rectangular, nearly square configuration formed by the converging side faces 24, 24 and the outer and inner faces 30 and 32 of the head which merge into a circumferential chamfered portion 34 adjacent the hammer face 28.

Figure 9:
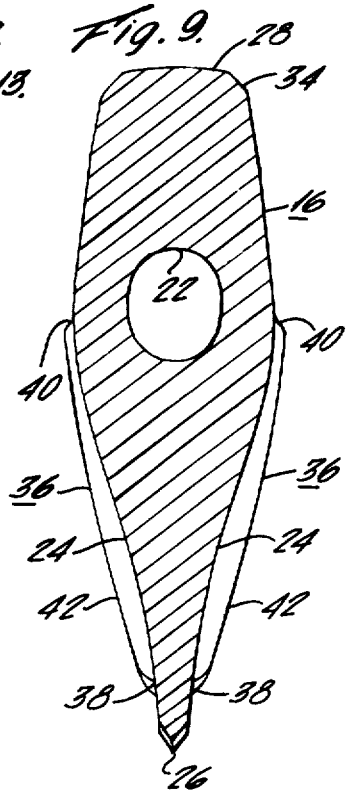
FIG. 9 is a sectional view taken along line 9—9 of FIG. 5.
Figure 10:
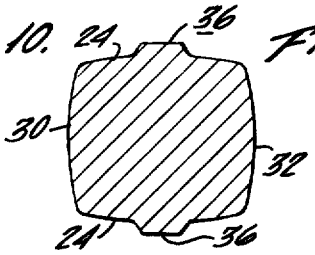
FIGS. 10-13 are sectional views taken from FIG. 8 respectively along lines 10—10, 11—11, 12-13 and 13—13.

As shown in the sectional view of FIG. 9, the head is shaped with a maximum thickness in the region adjacent the handle bore 22 and the side faces have a slightly concave configuration between the handle region and the cutting edge 26. The side faces converge somewhat toward the hammer face 28.

Figure 7:
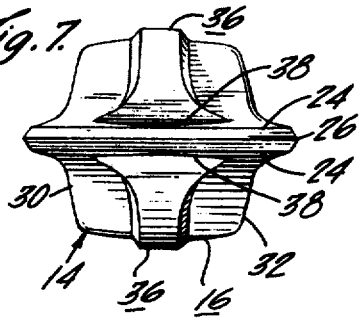
FIG. 7 is an end view of the cutting edge end of the splitting maul shown in FIG. 5.
Figure 11:
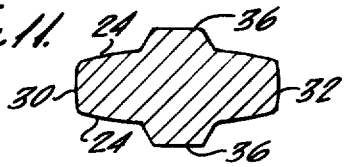
Figure 12:
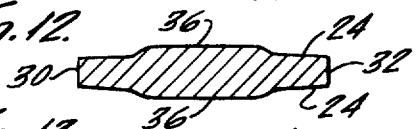
Figure 13:
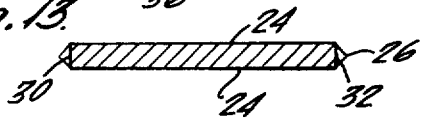

The maul head as described thus far is of a conventional shape. The improvement of the present invention comprises the addition of a pair of opposed ears 36, 36 to the wood splitting end of the maul head. As shown most clearly in FIGS. 5, 7 and 9, each ear 36 is disposed centrally of a face 24 and extends from a front or leading edge 28 longitudinally along the face 24 to a back or trailing edge 40 generally opposite the handle bore 22. As shown in FIGS. 5 and 7, the front or entry portion of each ear is flared so that the leading edge 38 of the ear is substantially wider than the remainder of the ear and has a width equal approximately to half the width of the face 24 at that point. The rear portion of each ear is substantially narrower in width than the maul face 24 and in the preferred embodiment shown is approximately one third the width of the face at any given point.

As shown most clearly in FIG. 9, the outer surface 42 of each ear 36 has a slight convex longitudinal curvature over most of its length and a more pronounced convex curvature adjacent the leading edge 38. The leading edge 38 of each ear is preferably a curved edge parallel to the cutting edge 26 and is spaced therefrom to permit the entry of the cutting edge a sufficient distance into a log to start a splitting action prior to the engagement of the ears with the log portions as shown in FIGS. 2 and 3 and described herebelow. As shown in the drawings, the side and rear edges of the ears may be beveled for strength and to minimize the surface area of the ears.

Although it is conceivable that the ears 36 could be welded, bolted, bonded or in some other fashion attached to a maul head, in the preferred embodiment of the invention the ears are cast integrally with the head, thereby greatly simplifying the manufacture of the device and assuring that there is no danger of pieces flying loose during its use.

In use, the improved splitting maul incorporating the present invention is swung downwardly toward the end of an upstanding log in the conventional manner to deliver a hard downward stroke of the maul head with the cutting edge 26 directed centrally into the log end as shown in FIG. 2. FIGS. 2-4 represent successive stages of a single stroke of the maul. In most instances a single stroke is all that is required to split a log into two pieces.

In FIG. 2 it can be seen that the cutting edge 26 initially creates an incipient split of the log prior to engagement of the log by the leading edge 38 of the ears. As the head continues downwardly, the wedge-shaped entry portion of the ears enters the split begun by the cutting edge 26 and transmits a sharp lateral thrust to the log portions. As shown in FIG. 3, the ears serve to widen the split in the log to a greater degree than would have been possible by entry of the side faces 24 of the head alone as evidenced by the fact that the faces 24 are no longer in engagement with the log section. As shown in FIG. 4, the continued entrance of the maul head into the log results in the rapidly increased widening of the rift between the log portions and the log then splits into two pieces.

Because of the relatively narrow width of the ears with respect to the faces 24, friction is greatly diminished in contrast to conventional splitting tools. As indicated above, after the initial penetration of the cutting edge to begin the splitting of the log, the log portions are engaged only by the ears, assuming that the log splits cleanly. It is recognized that this is not always the case, but it can nonetheless be stated that the predominent lateral thrust conveyed from the head to the log portions is conveyed by the engagement of the ears with the log and not the side faces 24 of the head.

It can be appreciated that the spacing of the leading edge of the ears from the cutting edge 26 is an important aspect of the invention. Were the ears to extend to the cutting edge, the initial entry would be impeded by the excess width of the edge and, in harder wood in particular, the initiation of the splitting action might be difficult or impossible. The spacing of the leading edge of the ears from the cutting edge can be varied to some degree but in the preferred embodiment is approximately $\frac{5}{8}$ of an inch.

Although the flared shapes of the ears and of the faces 24 of the maul head are the preferred forms of these elements, it is recognized that other forms could be successfully utilized, for example those having straight edges.

Manifestly, other changes in details of construction could be effected by those skilled in the art without departing from the spirit of the invention.

I claim:

1. A maul head for a wood splitting maul comprising opposed side faces converging toward one end to form a cutting edge, a transverse bore in said head adapted to receive one end of a handle, said handle bore being substantially spaced from and having an axis lying in the same plane as said cutting edge, said handle bore being located in the region of maximum thickness of said maul head, the width of said faces at said cutting edge exceeding the width of said faces at the handle bore, a raised ear disposed centrally on each said side face, each said ear extending longitudinally from a leading edge to a trailing edge along said side face, the width of each said ear throughout its length being substantially narrower than the width of the side face, the leading edge of each said ear being substantially parallel to and substantially spaced longitudinally from said cutting edge, each said ear tapering in thickness adjacent its leading edge to provide a wedge-shaped entry portion, the distance between the outer faces of said ears progressively increasing from the leading edges to the trailing edges of said ears.

2. The invention as claimed in claim 1 wherein said trailing edges of said ears are disposed substantially opposite said handle bore.

3. The invention as claimed in claim 1 wherein the leading edge of each said ear and the entry portion thereof adjacent the leading edge are substantially wider than the remainder of said ear.

4. The invention as claimed in claim 1 wherein the end of said maul head opposite said cutting edge comprises a hammer face.

* * * * *